United States Patent [19]

Tominaga

[11] Patent Number: 4,989,744

[45] Date of Patent: Feb. 5, 1991

[54] PORTABLE CONTAINER

[75] Inventor: Kazutoshi Tominaga, Higashiosakashi, Japan

[73] Assignee: Kabushiki Kaisha Tominaga Jyushi Kogyosho, Osaka, Japan

[21] Appl. No.: 478,355

[22] Filed: Feb. 12, 1990

[51] Int. Cl.[5] ..... B65D 25/32

[52] U.S. Cl. ..... 220/94 A; 220/94 R; 220/346

[58] Field of Search ..... 220/83, 94 A, 94 R, 220/339, 346

[56] References Cited

U.S. PATENT DOCUMENTS 3,111,153 11/1963 Sonka et al. ..... 220/94 R X
3,525,429 8/1970 Vaughn ..... 220/94 R
3,586,200 6/1971 Kramer et al. ..... 220/94 R
3,627,113 12/1971 DiIoia ..... 220/94 A X
4,168,024 9/1979 D'Alo ..... 220/94 R X
4,357,042 11/1982 Gall ..... 220/94 R X
4,792,055 12/1988 Schupack ..... 220/94 A

*Primary Examiner*—Steven M. Pollard
*Attorney, Agent, or Firm*—Collard, Roe & Galgano

[57] ABSTRACT

A portable container made in one piece of plastics, having a body portion; a cover portion hinged to the body portion; a handle portion including a main portion and leg portions, the leg portions being rotatively connected to the body portion, wherein the leg portions have branched portions engageable with projections formed on the edges of opposite rims of the body portion so that the leg portions is enabled to lock on the projections.

5 Claims, 3 Drawing Sheets

PORTABLE CONTAINER

BACKGROUND OF THE INVENTION

1. Field of the Invention

The present invention relates to a closable container used not only for carrying small animal and plants but also for storing, displaying and growing pet animals and plants at shops and homes.

2. Description of the Prior Art

In general, when a shopper buy a small animal such as hamster, mouse, the common practice is that the shopkeeper picks up an animal or plant from a stock cage, and transfers it to a carton. The carton is made of thick cardboard, and has the following disadvantages:

(1) It provides no beautiful appearance.

(2) Unless specially made, the cardboard is not transparent, and the animal or plant inside the carton cannot be see.

(3) The production cost is high.

(4) A troublesome work is required when the animal or plant is transferred from the stock cage to the carton.

As a substitute plastic boxes are used. The plastic box has one advantage that it allows animals and plants to be fed in it without using a large stock cage. Another advantage is that the animal and/or plants inside can be seen through the transparent walls. However, a disadvantage is the difficulty of assemblage. A one-piece plastic box is difficult to make, and it is composed of a body, a cover, and a handle. Each component is molded. The same number of molds as that of the components are required, and the assemblage of components requires labor. As a result, the plastic boxes are expensive for containers of pet animals and plants.

OBJECTS AND SUMMARY OF THE INVENTION

Accordingly, the present invention is directed toward a portable container which solves the problems discussed above, and an object of the present invention is to provide a portable container capable of production at low cost.

Another object of the present invention is to provide a portable container usable as not only for transport but also for storage in keeping animals and plants.

According to the present invention there is provided a portable container made in one piece of plastics, having a body portion; a cover portion hinged to the body portion; a handle portion including a main portion and leg portions, the leg portions being rotatively connected to the body portion, wherein the leg portions have branched portions engageable with projections formed on the edges of opposite rims of the body portion so that the leg portions is enabled to lock on the projections.

DETAILED DESCRIPTION OF THE INVENTION

Figure 1:
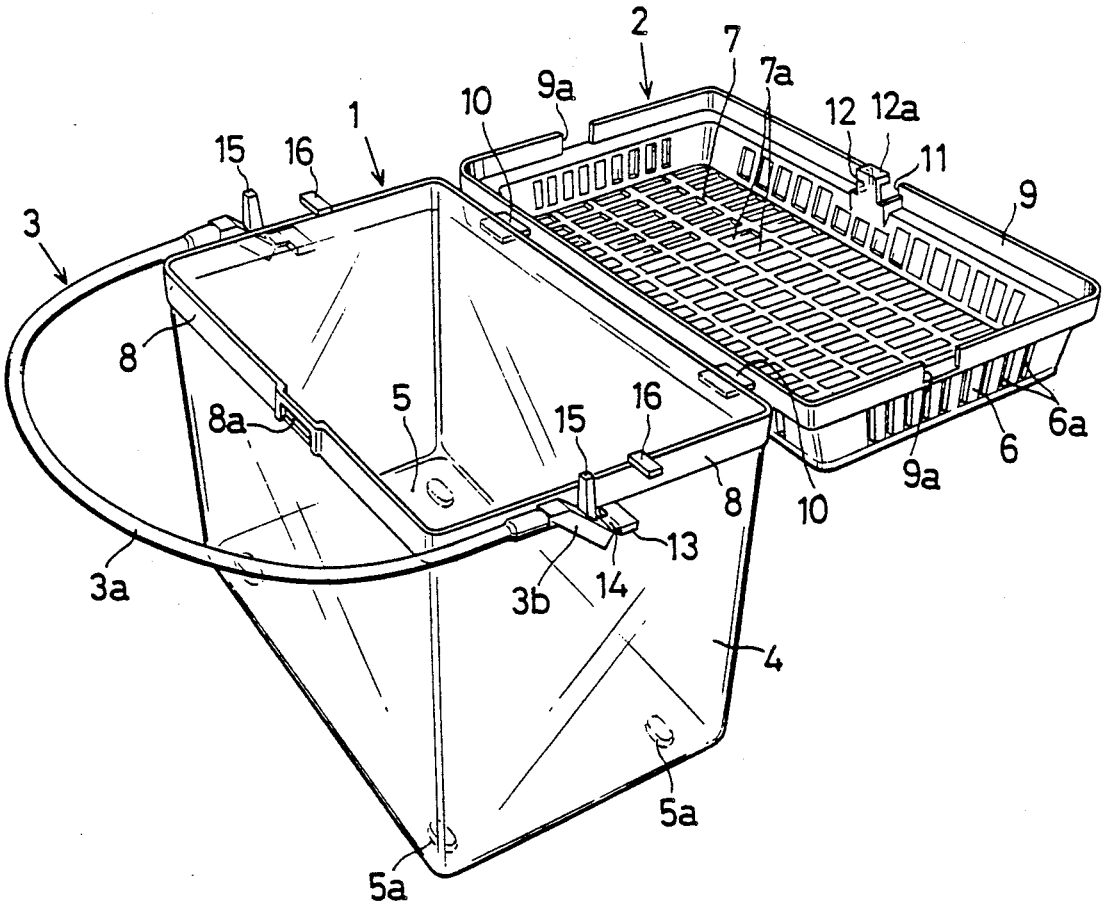
FIG. 1 is a perspective view showing a portable container according to the present invention.

Referring to FIG. 1, which illustrated an example of the embodiment, the container includes a body 1, a cover 2 hinged to the body 1, and a handle 3 rotatably connected to the body 1. The cover mates with the body to form an enclosure. The container is made in one piece of nonflexible plastics such as polystyrene. The one-piece fabrication of the container is economical in material and labor costs. This reflects in the total price of the container.

Figure 2:
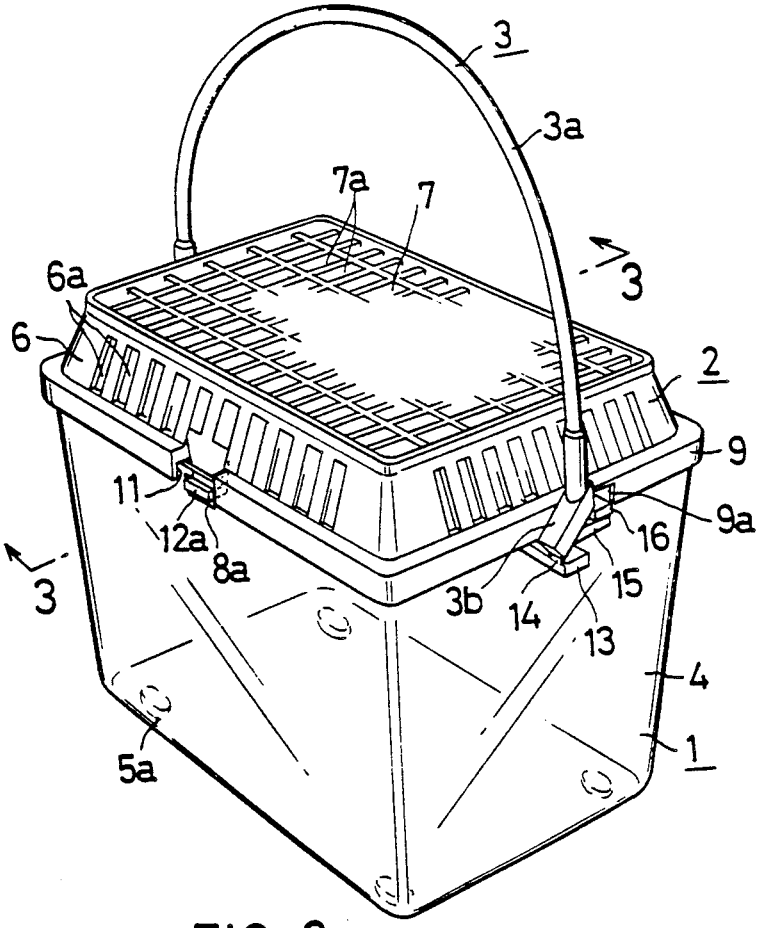
FIG. 2 is a perspective view showing the portable container of FIG. 1 in use.
Figure 3:
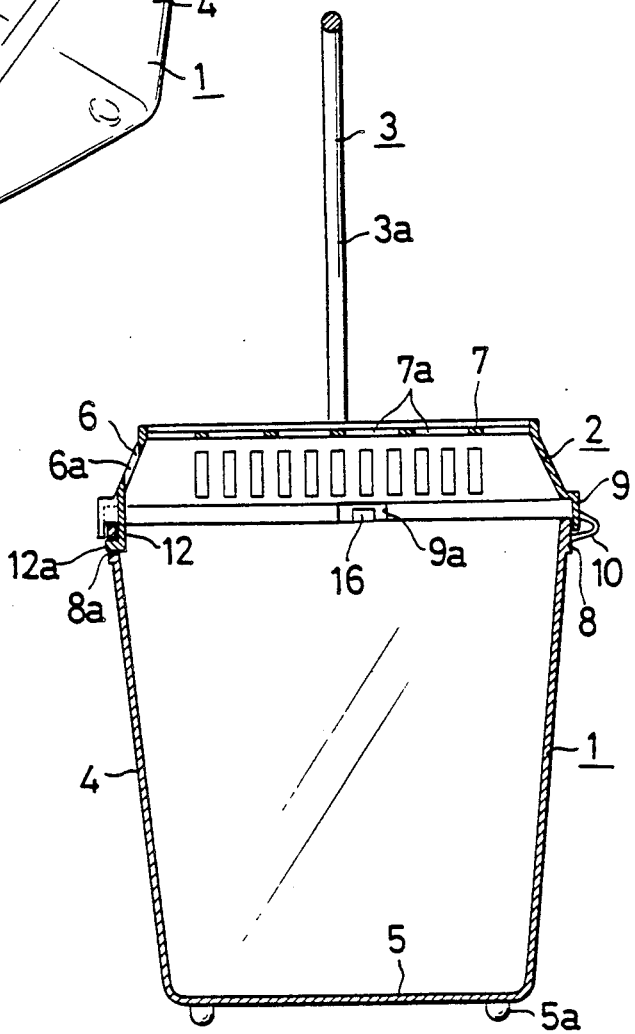
FIG. 3 is a cross-sectional view taken along the line 3—3.

The body 1 has four side walls 4 which as a whole slightly diverge upward, and a bottom wall 5 including a leg 5*a* projecting outward at each corner. The cover 2 has four side walls 6 and a top wall 7. The side walls 6 are slightly diverged upward as best shown in FIGS. 2 and 3. The body 1 has an opening defined by a rim 8, and the cover 2 has an opening defined by a rim 9. When the cover 2 is closed over the body 1, the rim 9 covers the rim 8 as shown in FIG. 3.

The cover 2 is provided with many ventilating pores 6*a* and 7*a* in the side walls 6 and the top wall 7. The body 1 and the cover 2 are hinged to each other by flexible hinge portions 10. The cover 2 has a recess 11 in the opposite side wall 6 to that having the hinge portions 10, and an engager bar 12 having a pawl 12*a* in the recess 11. The rim 8 of the body 1 has a hole 8*a* in which the pawl 12*a* fits from inside the body 1 as shown in FIG. 3. In this way the body 1 and the cover 2 are locked by engagement of the pawl 12*a* with the hole 8*a* shown in FIGS. 2 and 3.

Figure 4:
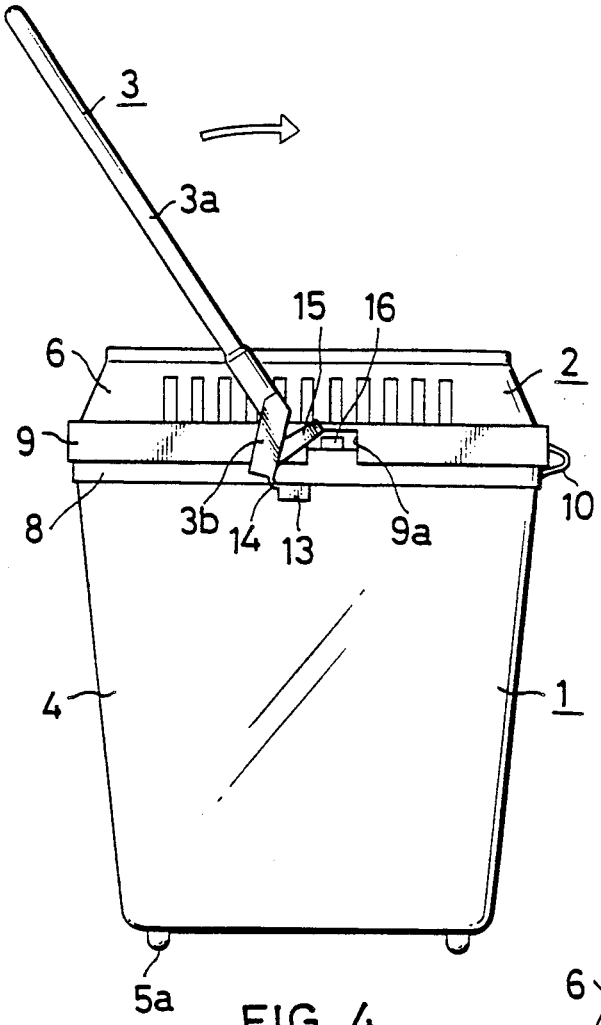
FIG. 4 is a side view of the container particularly showing a handle being erected.
Figure 5:
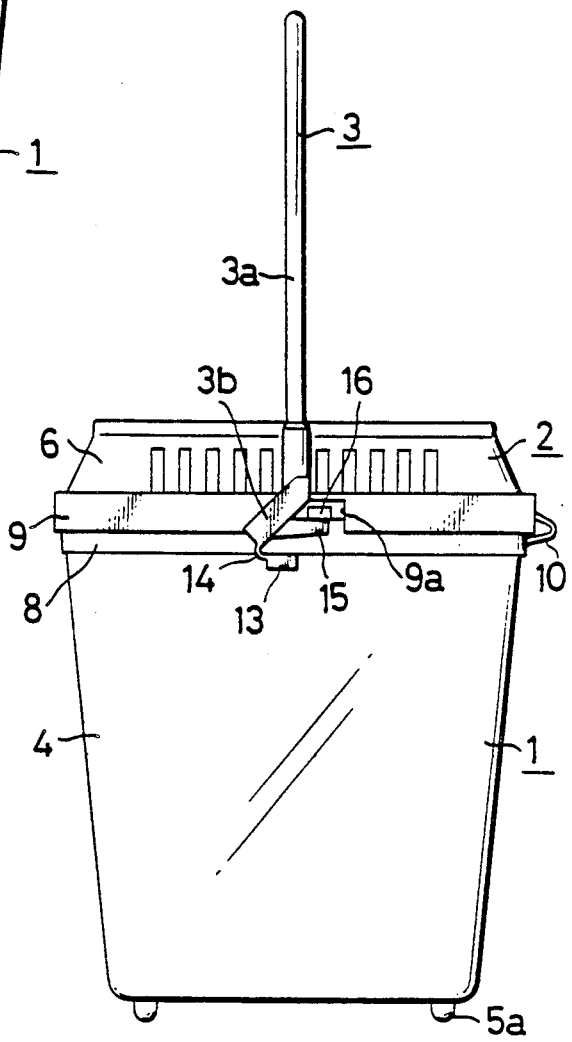
FIG. 5 is a side view of the container particularly showing a handle erected as a grip.

The handle 3 is in one piece with the body 1, extending from projecting base portions 13 formed on the opposite side walls 4 of the body 1. The reference numerals 3*b* and 14 denote a leg portion of the handle 3, and a flexible hinge, respectively. As shown in FIGS. 4 and 5, the leg portions 3*b* are bent at about 45° to the main portion 3*a*. The handle 3 is rotatable around the projecting base portions 13 owing to the flexibility of the hinge portions 14. Each leg portion 3*b* has a branched portion 15 which is engageable with a projection 16 formed on the edge of the ri 4 as best shown in FIG. 1. In FIG. 1 the handle 3 is rotated in the direction of arrow, thereby bringing the branched portion 15 into abutment with the projection 16. A further force is applied to the handle 3 so that the branched portion 15 comes under the projection 16 and is locked to the projection 16 with the handle 3 being maintained upright as shown in FIG. 5. The rims 9 of the cover 2 have recesses 9*a* at positions corresponding to the projections 16 so that the rims 8 of the body 1 and the rims 9 of the cover 2 mate with each other.

The container is molded in one piece in such a manner as to ensure that the open ends of the body 1 and of the cover 2, and a folded handle 3 are on the same plane as shown in FIG. 1. The level structure is convenient for stacking a plurality of containers when they are stored. One-piece construction eliminates a worry about the missing of one or other components.

For use, the cover 2 is closed so that the rims 8 and 9 mate with each other to form an enclosure with the handle 3 kept upright, wherein the branched portions 15 are engaged with the projections 16. The user grasps the handle 3 and carries the container with him or her.

The container can be used for storing foods such as meat, fish, cake and vegetables, which require air to keep fresh. Where necessary, the ventilating pores *6a* and *7a* can be dispensed with.

What is claimed is:

1. A portable container made in one piece of plastics, the container comprising:

a body portion;

a cover portion hinged to the body portion;

a handle portion including a main portion and leg portions, the leg portions being rotatively connected to the body portion, wherein the leg portions have branched portions engageable with projections formed on the edges of opposite rims of the body portion so that the leg portions are enabled to lock on the projections.

2. A portable container according to claim 1, wherein the cover comprises a locking means for fastening the cover to the body.

3. A portable container according to claim 1, wherein the handle portion comprises flexible hinge portions integral with the body portion.

4. A portable container according to claim 3, wherein the flexible hinge portions comprise projecting base portions formed on the opposite side walls of the body.

5. A portable container according to claim 3, wherein the body, the cover and the handle are made of transparent or translucent plastics.

* * * * *